US006294300B1

(12) United States Patent
Carmichael et al.

(10) Patent No.: US 6,294,300 B1
(45) Date of Patent: Sep. 25, 2001

(54) CHARGE GENERATION LAYER FOR ELECTROPHOTOGRAPHIC IMAGING MEMBER AND A PROCESS FOR MAKING THEREOF

(75) Inventors: Kathleen M. Carmichael, Williamson; Anthony M. Horgan, Pitlsford; Satchidanand Mishra, Webster; Donald P. Sullivan, Rochester, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/487,579

(22) Filed: Jan. 19, 2000

(51) Int. Cl.[7] ..... G03G 5/047

(52) U.S. Cl. ..... 430/58.8; 430/59.1; 430/59.4; 430/132; 430/133

(58) Field of Search ..... 430/58.8, 59.1, 430/59.4, 58.05, 74, 133, 132, 57.1, 57.2, 57.3

(56) References Cited

U.S. PATENT DOCUMENTS

| | | | | |
|---|---|---|---|---|
| 3,121,006 | | 2/1964 | Middleton et al. . | |
| 3,357,989 | | 12/1967 | Byrne et al. . | |
| 3,442,781 | | 5/1969 | Weinberger . | |
| 3,899,329 | | 8/1975 | Bean et al. . | |
| 4,232,103 | | 11/1980 | Limburg et al. . | |
| 4,265,990 | | 5/1981 | Stolka et al. | 430/96 |
| 4,415,639 | | 11/1983 | Horgan | 430/64 |
| 4,882,253 | * | 11/1989 | Kato et al. | 430/58.8 |
| 4,943,508 | * | 7/1990 | Yu | 430/58.8 |
| 5,019,473 | * | 5/1991 | Nguyen et al. | 430/74 |
| 5,164,276 | | 11/1992 | Robinson et al. | 430/83 |
| 5,437,950 | | 8/1995 | Yu et al. | 430/83 |
| 5,521,047 | | 5/1996 | Yuh et al. | 430/134 |
| 5,677,094 | * | 10/1997 | Umeda et al. | 430/58.05 |
| 5,709,974 | | 1/1998 | Yuh et al. | 430/66 |
| 5,804,343 | * | 9/1998 | Umeda et al. | 430/96 |
| 5,863,686 | | 1/1999 | Yuh et al. | 430/83 |
| 5,891,594 | | 4/1999 | Yuh et al. | 430/71 |
| 5,922,498 | | 7/1999 | Yuh et al. | 430/60 |
| 6,022,657 | * | 2/2000 | Fuller et al. | 430/59.1 |

* cited by examiner

*Primary Examiner*—Janis L. Dote
(74) *Attorney, Agent, or Firm*—Oliff & Berridge, PLC; Eugene O. Palazzo

(57) ABSTRACT

A photoconductor includes a charge transport layer coated over a charge generator layer. A hole transport molecule is intentionally added to the charge generator layer preventing migration of hole transport molecules from the charge transport layer to the charge generator layer.

17 Claims, 2 Drawing Sheets

CHARGE GENERATION LAYER FOR ELECTROPHOTOGRAPHIC IMAGING MEMBER AND A PROCESS FOR MAKING THEREOF

BACKGROUND OF THE INVENTION

1. Field of Invention

This invention is generally directed to imaging members for electrophotography. More specifically, this invention is directed to a process for preparing a charge generation layer for electrophotographic imaging members, and to electrophotographic imaging members produced thereby.

2. Description of Related Art

In electrophotography, an electrophotographic substrate containing a photoconductive insulating layer on a conductive layer is imaged by first uniformly electrostatically charging the surface. The plate is then exposed to a pattern of activating electromagnetic radiation, such as light. The light or other electromagnetic radiation selectively dissipates the charge in the illuminated areas of the photoconductive insulating layer while leaving behind an electrostatic latent image in the non-illuminated areas. This electrostatic latent image may then be developed to form a visible image by depositing finely divided electroscopic marking particles on the surface of the photoconductive insulating layer. The resulting visible image may then be transferred from the electrophotographic plate to a support such as paper. This image developing can be repeated as many times as necessary with reusable photoconductive insulating layers.

An electrophotographic imaging member may take one of many different forms. For example, layered photoresponsive imaging members are known in the art. U.S. Pat. No. 4,265,990, which is incorporated herein by reference in its entirety, describes a layered photoreceptor having separate photogenerating and charge transport layers. The photogenerating layer is capable of photogenerating holes and injecting the photogenerated holes into the charge transport layer. Thus, in photoreceptors of this type, the photogenerating material generates electrons and holes when subjected to light.

More advanced photoconductive receptors contain highly specialized component layers. For example, a multilayered photoreceptor that can be employed in electrophotographic imaging systems can include one or more of a substrate, an undercoating layer, an optional hole or charge blocking layer, a charge generating layer (including photogenerating material in a binder) over the undercoating and/or blocking layer, and a charge transport layer (including charge transport material in a binder). Additional layers such as an overcoating layer or layers can also be included. See, for example, U.S. Pat. Nos. 5,891,594 and 5,709,974.

The photogenerating layer utilized in multilayered photoreceptors can include, for example, inorganic photoconductive particles or organic photoconductive particles dispersed in a film forming polymeric binder. Inorganic or organic photoconductive material may be formed as a continuous, homogeneous photogenerating layer.

In photoreceptors of the above type, the photogenerating material generates electrons and holes when subjected to light. In the case of a photoreceptor that includes a hole blocking layer, the blocking layer prevents holes in the conductive ground plane from passing into the generator from which they would be conducted to the photoreceptor surface thus erasing any latent image formed thereon. The hole blocking layer does permit electrons generated in the generator to pass to the conductive ground plane, preventing an undesirably high electric field to build up across the generator upon cycling the photoreceptor. See, for example, U.S. Pat. No. 5,891,594.

U.S. Pat. No. 5,164,276 to Robinson et al., the disclosure of which is incorporated herein by reference in its entirety, and having a common assignee to the present application, discloses the addition of N,N'-diphenyl-N,N'-bis[3-methylpropyl]-[1,1'-biphenyl]-4,4'-diamine, a charge transport material that contains charge transport molecules, to a charge generating layer containing inorganic trigonal selenium in order to stabilize the variable cycle down that existed as a problem for inorganic photoconductive particles, such as trigonal selenium. Cycle down is defined as a decline in the Vddp with successive charge 1 erase cycles using constant current charging. For organic photoconductive particles, such as benzimadazole perylene, cycle down is generally not a problem since the organic pigments generally do not show cycle down.

U.S. Pat. No. 5,863,686 to Yuh et al., the disclosure of which is incorporated herein by reference in its entirety, and having a common assignee to the present application, discloses a photoreceptor including a charge generating layer containing a donor charge transport molecule selected from N,N'-diphenyl-N,N'-bis(3-hydroxyphenyl)-1,1'-biphenyl-4,4'-diamine and N,N'-di(3-methylphenyl)-N,N'-diphenyl-1,1'-biphenyl-4,4'-diamine. Yuh also discloses a charge transport layer comprising N,N'-diphenyl-N,N'-bis(3-methylphenyl)-1,1'-biphenyl-4,4'-diamine. A similar photoreceptor design is disclosed in U.S. Pat. No. 5,922,408 also to Yuh et al., the disclosure of which is also incorporated herein by reference in its entirety. Yuh does not use N,N'-diphenyl-N,N'-bis(3-methylpropyl)-1,1'-biphenyl-4,4'-diamine in the charge generating layer.

SUMMARY OF THE INVENTION

Generally, electrophotographic imaging members include a supporting substrate having an electrically conductive surface or coated with an electrically conductive layer, an optional charge blocking layer, an optional undercoat layer, a charge generating layer, a charge transport layer and an optional overcoating layer.

When the charge transport layer is coated over the charge generator layer, a problem that often occurs is that the hole transport molecule in this charge transport layer tends to migrate into the charge generator layer. This results in a disruption of the charge generator layer thickness and pigment loading uniformity. For example, such migration of the charge transport molecule causes the effective thickness of the charge generating layer to increase, and causes a gradient or blurring to occur at the interface of the charge transport layer and the charge generating layer. As the migration proceeds and increases, the photosensitivity of the photoreceptor, and particularly of organic photoreceptors (i.e., those using organic species as the charge generating material) decreases and becomes less predictable. As a result, the xerographic properties may be changed.

As a result of the altered properties of the photoreceptors resulting from migration of the charge generating material, production costs of the photoreceptors generally increases. For example, due to the variation in properties even from one photoreceptor to another, extra monitoring and inspection in the production processes is required. Furthermore, a significant number of photoreceptors are unsuitable for use based on the decreased sensitivity, and therefore are wasted. This results in a decrease in production efficiency as well as an increase in product cost.

Accordingly, a need exists in the art for ways to form photoreceptors, particularly organic photoreceptors, that exhibit predictable and reliable photogenerating properties, such as sensitivity. A need also exists for a means to eliminate or reduce migration of charge transport molecules from the charge transport layer into the photogenerating layer.

The present invention provides photoreceptors and methods of making such photoreceptors in which the hole transport molecule is intentionally added to the organic photoconductor containing charge generation layer to block migration from the charge transport layer. For example, many charge generating materials such as benzimidazole perylene (BzP) are extrinsic photoconductors which need contact with the hole transport molecule to photogenerate. The addition of the hole transport molecule to the charge generation layer can provide a more uniform contact with the charge generating material while not having to rely on the random distribution of the molecule in the charge generation layer. The uniform distribution of the charge transport molecule, such as N,N'-diphenyl-N,N'-bis(3-methylpropyl)-(1,1'-biphenyl)-4,4'-diamine, in the charge transport layer also can help increase supply efficiency.

Thus one advantage of the present invention is the elimination of swelling in the charge generating layer when the charge transport layer is applied, keeping the thickness of the charge generating layer constant. Another advantage of the claimed invention is that photoreceptors with more reliable, and even increased, sensitivity are provided.

These and other features and advantages of this invention are described in or are apparent from the following detailed description of the preferred embodiments.

BRIEF DESCRIPTION OF THE DRAWINGS

The preferred embodiments of this invention will be described in detail, with reference to the following drawing figures, in which.

DETAILED DESCRIPTION OF PREFERRED EMBODIMENTS

Figure 1:
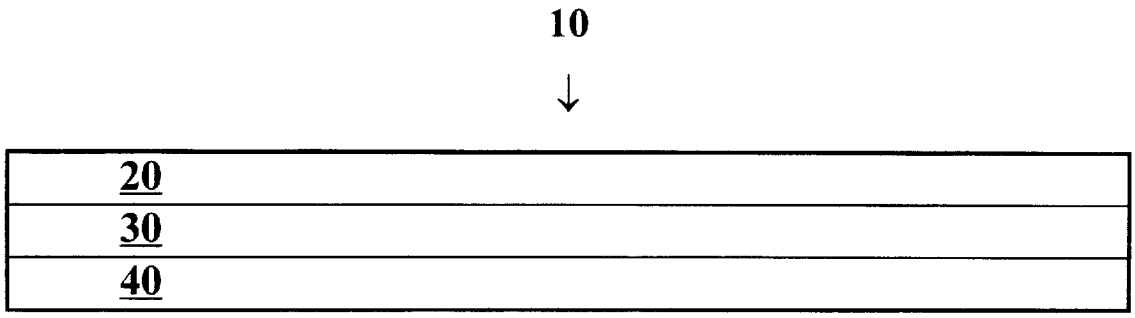
FIG. 1 is a schematic drawing of a photoreceptor.

FIG. 1 generally illustrates an exemplary embodiment of a photoconductor in accordance with the present invention.

The photoconductor 10 includes a charge transport layer 20, a charge generating layer 30 and a substrate 40. Of course, other layers, for example including but not limited to undercoatings, conductive coatings, underlayers, adhesive layers, blocking layers, anti-curl layers, overlayers and the like, may also be included in a photoconductor in accordance with this invention.

As discussed above, in conventional photoconductors or other electrophotographic imaging members, when the charge transport layer is applied over the charge generating layer, charge transport molecules tend to migrate from the charge transport layer to the charge generating layer, causing the charge generating layer to swell.

In accordance with this invention, charge transport components are included to both the charge transport layer 20 and the charge generating layer 30. Preferably the same charge transport component in substantially the same concentration is included in both the charge transport layer 20 and the charge generating layer 30, or at the interfacing surface of each layer 20 and 30. Of course, different charge transport components and/or different concentrations thereof can be used, in embodiments, so long as the objectives of the present invention are achieved.

With this intentional addition of the hole transport component to the charge generation layer, migration of the hole transport molecule from the charge transport layer to the organic photoconductor containing charge generation layer is blocked, preventing the swelling of the charge generating layer, as is common in the art, thus improving the photoreceptors thus formed. This is particularly beneficial for the charge generating material benzimidazole perylene, which is an extrinsic photoconductor requiring contact with the hole transport molecules to photogenerate. A further advantage provided by the present invention is that a more uniform distribution of the charge transport material remains in the charge transport layer. That is, because the charge transport material does not migrate from the charge transport layer to the charge generating layer, the uniform distribution within the charge transport layer is not disrupted.

Preferably, the added hole transport component replaces binder, or alternatively binder and charge generating material in the charge generating layer.

The exact mechanism by which migration of the hole transport molecules to the charge generating layer occurs is not fully understood. Thus, while in this application, the intentional addition of the hole transport layer is described as blocking such migration, it may be that the intentional addition creates an equilibrium migration, such that the amount migrating from the charge transport layer to the charge generating layer is substantially the same as an amount that may migrate from the charge generating layer to the charge transport layer.

Nevertheless, regardless of the exact mechanism of operation, the addition of the hole transport molecule to the charge generation layer provides a more uniform contact with the photoconductive material. The uniform distribution of the charge transport molecule in the charge transport layer also helps to increase supply efficiency.

Any suitable photogenerating layer may be applied to the adhesive or blocking layer, which in turn can then be overcoated with a contiguous hole (charge) transport layer as described hereinafter. Examples of typical photogenerating layers include, but are not limited to, organic photoconductive particles including various phthalocyanine pigment such as the X-form of metal free phthalocyanine described in U.S. Pat. No. 3,357,989, metal phthalocyanines such as vanadyl phthalocyanine, hydroxygallium phthalocyanine, and copper phthalocyanine, dibromoanthanthrone, squarylium, quinacridones available from Dupont under the tradename MONASTRAL RED, MONASTRAL VIOLET and MONASTRAL RED Y, VAT ORANGE 1 and VAT ORANGE 3 trade names for dibromo anthanthrone pigments, benzimidazole perylene, perylene pigments as disclosed in U.S. Pat. No. 5,891,594, the entire disclosure of which is incorporated herein by reference, substituted 2,4-diamino-triazines disclosed in U.S. Pat. No. 3,442,781, polynuclear aromatic quinones available from Allied Chemical Corporation under the tradename INDOFAST DOUBLE SCARLET, INDOFAST VIOLET LAKE B, INDOFAST BRILLIANT SCARLET and INDOFAST ORANGE, and the like dispersed in a film forming polymeric binder. Multi-photogenerating layer compositions may be utilized where a photoconductive layer enhances or reduces the properties of the photogenerating layer. Examples of this type of configuration are described in U.S. Pat. No. 4,415,639, the entire disclosure of which is incorporated herein by reference. Other suitable photogenerating materials known in the art may also be utilized, if desired.

Charge generating binder layers comprising particles or layers comprising a photoconductive material such as vanadyl phthalocyanine, metal free phthalocyanine, benzimidazole perylene, and the like and mixtures thereof are especially preferred because of their sensitivity to white light. Vanadyl phthalocyanine and metal free phthalocyanine are also preferred because these materials provide the additional benefit of being sensitive to infra-red light.

Any suitable polymeric film forming binder material may be employed as the matrix in the photogenerating binder layer. Typical polymeric film forming materials include, but are not limited to, those described, for example, in U.S. Pat. No. 3,121,006, the entire disclosure of which is incorporated herein by reference. Thus, typical organic polymeric film forming binders include, but are not limited to, thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly (amideimide), styrene-butadiene copolymers, vinylidenechloride-vinylchloride copolymers, vinylacetate-vinylidenechloride copolymers, styrene-alkyd resins, polyvinylcarbazole, mixtures thereof, and the like. These polymers may be block, random or alternating copolymers.

The photogenerating composition or pigment may be present in the resinous binder composition in various amounts. Generally, however, the photogenerating composition or pigment may be present in the resinous binder in an amount of from about 5 percent by volume to about 90 percent by volume of the photogenerating pigment dispersed in about 10 percent by volume to about 95 percent by volume of the resinous binder, and preferably from about 30 percent by volume to about 60 percent by volume of the photogenerating pigment is dispersed in about 40 percent by volume to about 70 percent by volume of the resinous binder composition. In one embodiment, about 8 percent by volume of the photogenerating pigment is dispersed in about 92 percent by volume of the resinous binder composition.

The photogenerating layer containing photoconductive compositions and/or pigments and the resinous binder material generally ranges in thickness of from about 0.1 micrometer to about 5.0 micrometers, and preferably has a thickness of from about 0.3 micrometer to about 3 micrometers. The photogenerating layer thickness is generally related to binder content. Thus, for example, higher binder content compositions generally require thicker layers for photogeneration. The charge generating layer may have a thickness of about 1 micron prior to forming the charge transport layer and said charge generating layer may have a thickness of about 1 micron after the charge transport layer. Of course, thickness outside these ranges can be selected providing the objectives of the present invention are achieved.

In addition to the binder materials and the charge generating materials, described above, the charge generating layer of the photoreceptors of the present invention also contain an appropriate amount of a charge transport material. Preferably, the charge transporting material is uniformly or homogeneously mixed with the binder material and the charge generating material, to form a uniform or homogeneous (or at least substantially so) composition throughout the charge generating layer. However, in embodiments, the charge transport material may be incorporated into the charge generating layer in such a form as to provide a concentration gradient of the charge transport material. In this embodiment, the concentration gradient is preferably provided such that the lower concentration of the charge transport material is located furthest from the subsequently applied charge transport layer, and the higher concentration of the charge transport material is located nearest to the subsequently applied charge transport layer.

According to the present invention, the charge transport material incorporated into the charge generating layer may be any of the suitable charge transport materials, such as those described below for direct incorporation into the charge transport layer. In embodiments, N,N'-diphenyl-N,N'-bis[3-methylpropyl]-[1,1'-biphenyl]-4,4'-diamine is particularly preferred. In a preferred embodiment, the charge generating layer comprises between 5 to 30% by weight of the hole transport component, N,N'-diphenyl-N,N'-bis(3-methylpropyl)-(1,1'-biphenyl)-4,4'diamine and 30 to 40% by weight of the organic photoconductive particle, benzimidazole perylene.

According to the present invention, the charge transport material is added to the charge generating layer in an amount effective to decrease, and preferably eliminate, migration of charge transport material from the charge transport layer to the charge generating layer upon application of the charge transport layer. Preferably, as discussed above, the amount of charge transport material added to the charge generating layer is in an amount to provide an equal concentration, or substantially equal concentration, of charge transport material in the charge generating layer and charge transport material in the charge transport layer, at least at the interface between the two layers.

In operative terms, the amount of charge transport material added to the charge generating layer should preferably be sufficient to prevent or minimize effective swelling of the charge generating layer, when the charge transport layer is applied. Swelling is believed to occur as charge generating material migrated into the charge transport layer, or as charge transport material migrates into the charge generating layer. Due to this migration, the optical density of the charge generating layer remains substantially the same, but the effective thickness (that is, the thickness related to the optical density) increases. In addition to this swelling phenomenon, the migration of material results in a decreased concentration of the charge generating material in the charge generating layer. Thus, for example, the amount of charge transport material added to the charge generating layer should preferably reduce the amount of swelling to less than 100% (in terms of changes in effective thickness of the layer). Preferably, swelling of the charge generating layer is reduced to less than about 50%, more preferably less than about 25%, and even more preferably less than about 10%. Preferably, in embodiments, swelling of the charge generating layer is substantially or completely eliminated as confirmed by transmission electron microscopy.

As used herein, the addition of charge transport material to the charge generating layer is described as "blocking migration." It is believed that the addition of charge transport material to the charge generating layer partially or completely blocks migration from the charge transport layer to the charge generating layer. However, it may be that an equilibrium may exist, whereby charge transport material may migrate back and forth between the two layers, particularly when charge transport material is initially included in the charge generating layer. However, for purposes of the present invention, "blocking migration" is used to mean that net migration of charge transport material from the charge transport layer to the charge generating layer is decreased, and preferably is substantially or completely eliminated.

Any suitable and conventional technique may be utilized to mix and thereafter apply the photogenerating layer coating mixture. Typical application techniques include spraying, dip coating, roll coating, wire wound rod coating, and the like. Drying of the deposited coating may be effected by any suitable conventional technique such as oven drying, infra red radiation drying, air drying and the like.

The electrophotographic imaging member formed by the process of the present invention generally contains a charge transport layer in addition to the charge generating layer. The charge transport layer comprises any suitable organic polymer or non-polymeric material capable of transporting charge to selectively discharge the surface charge. Charge transporting layers may be formed by any conventional materials and methods, such as the materials and methods disclosed in U.S. Pat. No. 5,521,047 to Yuh et al., the entire disclosure of which is incorporated herein by reference. In addition, the charge transporting layers may be formed as an aromatic diamine dissolved or molecularly dispersed in an electrically inactive polystyrene film forming binder, such as disclosed in U.S. Pat. No. 5,709,974, the entire disclosure of which is incorporated herein by reference.

Any suitable and conventional technique may be utilized to mix and thereafter apply the charge transport layer coating mixture to the charge generating layer. Typical application techniques include spraying, dip coating, roll coating, wire wound rod coating, and the like. Preferably, the transport layer comprises between about 40 percent and about 70 percent by weight binder, between about 30 percent and about 60 percent by weight charge transport material based on the dried layer. Drying of the deposited coating may be effected by any suitable conventional technique such as oven drying, infra-red radiation drying, air drying and the like.

Generally, the thickness of the charge transport layer is between about 10 and about 50 micrometers, but thickness outside this range can also be used. The charge transport layer should preferably be an insulator to the extent that the electrostatic charge placed on the charge transport layer is not conducted in the absence of illumination at a rate sufficient to prevent formation and retention of an electrostatic latent image thereon. In general, the ratio of thickness of the charge transport layer to the charge generator layer is preferably maintained from about 2:1 to 200:1 and in some instances as great as 400:1. In other words, the charge transport layer is substantially non-absorbing to visible light or radiation in the region of intended use but is "active" in that it allows the injection of photogenerated holes from the photoconductive layer, i.e., charge generation layer, and allows these holes to be transported through the active charge transport layer to selectively discharge a surface charge on the surface of the active layer.

In the above discussion, the photoreceptor has been described as having a charge generating layer located beneath (i.e., towards the non-imaging side of the photoreceptor) a charge transport layer. However, the present invention is not limited to such embodiments. Rather, the photoreceptor can also be formed such that the charge transport layer is located beneath the charge generating layer, if desired, as migration of the hole transport molecule can occur in either direction from high concentration to low concentration.

In combination with the materials for the charge generating layer and charge transport layer in accordance with this invention, conventional materials in conventional amounts may further be included in the layers. Examples of such other materials are described, for example, in U.S. Pat. Nos. 5,863,686 and 5,922,498, the disclosures of which are hereby incorporated by reference in their entirety.

The substrate and the layers other than the charge generating and charge transport layers of the electrophotographic imaging members of this invention can include various different conventional components and compositions and can include various different conventional characteristics and properties as may be required or desired. Examples of such other materials that can be used in the layers other than the layers in conjunction with this invention are described, for example, in U.S. Pat. Nos. 5,863,686 and 5,922,498, the disclosures of which are hereby incorporated by reference in their entirety.

For example, the substrate may be opaque or substantially transparent and may comprise numerous suitable materials having the required mechanical properties. For example, the substrate can include a layer of electrically non-conductive or conductive material such as an inorganic or an organic composition.

The electrically conductive layer can include the entire substrate or can be only a coating on an underlying rigid or flexible web member. Any suitable electrically conductive material can be utilized, such as and for examples, aluminum, titanium, nickel, chromium, brass, gold, stainless steel, copper iodide, etc.

When the conductive layer is flexible, it may vary in thickness over wide ranges depending on the desired use of the electrophotoconductive member. For example, in embodiments, the conductive layer may range in thickness from about 50 Angstrom units to about 150 micrometers.

Examples of conventional non-conducting materials that may be employed for the substrate include polyesters, polycarbonates, polyamides, polyurethanes, etc. The substrate may take any suitable shape such as, for example, a flexible web, a rigid cylinder, a sheet, etc.

In embodiments where the substrate is flexible, the thickness can depend on numerous factors, including economic considerations. Thus the layer for a flexible belt may be, for example, 200 micrometers or more (or less) or may be 50 micrometers or less (or more).

Any suitable hole blocking layer capable of forming an electric barrier to holes between the adjacent photoconductive layer and the underlying conductive layer may be utilized. A hole blocking layer may comprise any suitable material. Typical hole blocking layers utilized for negatively charged photoreceptors can include, for example, Luckamide (a polyamide film forming polymer available from Dai Nippon Ink), hydroxy alkyl methacrylates, nylons, gelatin, hydroxy alkyl cellulose, organopolyphosphazines, organosilanes, organotitanates, organozirconates, silicon oxides, zirconium oxides, etc.

The blocking layer may be applied by any suitable conventional technique such as spraying, dip coating draw bar coating, gravure coating, silk screening, air knife coating, reverse roll coating, vacuum deposition, chemical treatment, etc.

Any suitable organic solvent may be utilized to dissolve the film forming binder. Exemplary solvents include ethyl alcohol, heptane, n-butyl acetate, cyclohexane, methyl ethyl ketone, etc.

Other layers, such as conventional ground strips including, for example, conductive particles disposed in a film forming binder may be applied to one edge of the photoreceptor in contact with the conductive surface or layer, blocking layer, adhesive layer or charge generating layer.

Optionally, an overcoat layer can be utilized to improve resistance to abrasion. Also optionally, a back coating may be applied to the side opposite the imaging side of the photoreceptor to provide flatness and/or abrasion resistance. These overcoat and backcoat layers can include any suitable composition, such as, for example, organic polymers or inorganic polymers that are electrically insulating or slightly semi-conductive.

Examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLES

In the following examples, various photoreceptors are formed that include a charge generating layer comprised of 40% by volume benzimidazole perylene in polycarbonate PCZ 200 available from Mitsubishi Chemical Co., on which is coated a charge transport layer containing N,N'-diphenyl-N,N'-bis(3-methylpropyl)-(1,1'-biphenyl)-4,4'-diamine. The charge generating layer is coated to a selected optical density, such as about 2.0 at 660 nm. This translates to a thickness of about 1.0 micron as determined by TEM photography.

TEM photography of benzimidazole perylene charge generating layer thicknesses before and after charge transport layer coating with and without the addition of N,N'-diphenyl-N,N'-bis(3-methylpropyl)-(1,1'-biphenyl)-4,4'-diamine indicate that some of the N,N'-diphenyl-N,N'-bis(3-methylpropyl)-(1,1'-biphenyl)-4,4'-diamine migrates from the charge transport layer into the charge generating layer, producing a nonuniform interface with the charge transport layer and producing a thicker charge generating layer as the N,N'-diphenyl-N,N'-bis(3-methylpropyl)-(1,1'-biphenyl)-4,4'-diamine acts as additional "binder".

After the charge transporting layer is coated, the overall outer diameter of the photoreceptor remains unchanged. However, the thickness of the charge generating layer increases by about 100% in the case where no charge transport material is included in the charge generating layer. In contrast, addition of the N,N'-diphenyl-N,N'-bis(3-methylpropyl)-(1,1'-biphenyl)-4,4'-diamine to the charge generating layer reduces or eliminates the swelling, keeping the thickness and loading constant upon charge transport layer coating. With N,N'-diphenyl-N,N'-bis(3-methylpropyl)-(1,1'-biphenyl)-4,4'-diamine in the charge generating layer, a clear boundary exists at the charge generating layer/charge transport layer interface with no migration of the benzimidazole perylene.

A series of photoreceptors are fabricated with the amount of N,N'-diphenyl-N,N'-bis(3-methylpropyl)-(1,1'-biphenyl)-4,4'-diamine added to the charge generating layer varied. One series of test photoreceptors (Examples 1–3) maintained the BzP loading constant and replaced PCZ 200 with N,N'-diphenyl-N,N'-bis(3-methylpropyl)-(1,1'-biphenyl)-4,4'-diamine. Another series of test photoreceptors (Examples 4–7) added the N,N'-diphenyl-N,N'-bis(3-methylpropyl)-(1,1'-biphenyl)-4,4'-diamine, while dropping both the BzP and PCZ levels. The Xerographic data results are shown in the Table I below.

The xerographic properties of the photoconductive imaging samples prepared according to Examples 1 through 7 below are evaluated with a xerographic testing scanner comprising a cylindrical aluminum drum having a diameter of 24.26 cm (9.55 inches). The test samples are taped onto the drum. When rotated, the drum carrying the samples produces a constant surface speed of 76.3 cm (30 inches) per second. A direct current pin corotron, exposure light, erase light, and five electrometer probes are mounted around the periphery of the mounted photoreceptor samples. The sample charging time is 33 milliseconds. The expose light has a 670 nm output and the erase light is broad band white light (400–700 nm) output, each supplied by a 300 watt output Xenon arc lamp. The test samples are first rested in the dark for at least 60 minutes to ensure achievement of equilibrium with the testing conditions at 40 percent relative humidity and 21° C. Each sample is then negatively charged in the dark to a development potential of about 900 volts. The charge acceptance of each sample and its residual potential after discharge by front erase exposure to 400 ergs/cm$^2$ are recorded. Dark Decay is measured as a loss of Vddp after 0.66 seconds. The test procedure is repeated to determine the photo induced discharge characteristic (PIDC) of each sample by different light energies of up to 20 ergs/cm$^2$. The photodischarge is given as the ergs/cm$^2$ needed to discharge the photoreceptor from a Vddp 600 volts to 100 volts.

Example 1

An electrophotographic imaging member is prepared by providing a 0.02 micrometer thick titanium layer coated on a polyester substrate (MELINEX 442, available from ICI Americas, Inc.) having a thickness of 3 mils (76.2 micrometers) and applying thereto, using a ½ mil gap Bird applicator, a solution containing 10 grams gamma aminopropyltriethoxy silane, 10.1 grams distilled water, 3 grams acetic acid, 684.8 grams of 200 proof denatured alcohol and 200 grams heptane. This layer is then allowed to dry for 5 minutes at 135° C. in a forced air oven. The resulting blocking layer has an average dry thickness of 0.05 micrometer measured with an ellipsometer.

An adhesive interface layer is then prepared by applying with a ½ mil gap Bird applicator to the blocking layer a wet coating containing 0.5 percent by weight based on the total weight of the solution of polyester adhesive (MOR-ESTER 49,000, available from Morton International, Inc.) in a 70:30 volume ratio mixture of tetrahydrofuran/cyclohexanone. The adhesive interface layer is allowed to dry for 5 minutes at 135° C. in a forced air oven. The resulting adhesive interface layer has a dry thickness of 0.065 micrometer.

The adhesive interface layer is thereafter coated with a photogenerating layer containing 40 percent by volume benzimidazole perylene (BzP), and 50 percent by volume polycarbonate-Z (PC-Z) AND 10% by volume N,N'-diphenyl-N,N'-bis(3-methylpropyl)-(1,1'-biphenyl)-4,4'-diamine. This photogenerating layer is prepared by introducing 0.45 grams polycarbonate-Z and 60.2 mls of tetrahydrofuran into a 4 oz. amber bottle. To this solution is added 2.4 grams of BzP and 300 grams of ⅛ inch (3.2 millimeter) diameter stainless steel shot. This mixture is then placed on a ball mill for 72 to 96 hours. Subsequently, 1.31 grams of polycarbonate-Z and 0.24 grams of N,N'-diphenyl-N,N'-bis(3-methylpropyl)-(1,1'-biphenyl)-4,4'-diamine was dissolved in 26 grams of tetrahydrofuran, then added to 40 grams of this BzP slurry. This slurry is then placed on a shaker for 10 minutes. The resulting slurry is thereafter applied to the adhesive interface layer by using a ½ mil gap Bird applicator to form a coating layer having a wet thickness of 0.5 mil (12.7 micrometers). This photogenerating layer is dried at 135° C. for 5 minutes in a forced air oven to form a dry photogenerating layer having a thickness of 1.0 micrometers.

This coated imaging member web is simultaneously overcoated with a charge transport layer and a ground strip layer using a 3 mil gap Bird applicator. The charge transport layer is prepared by introducing into an amber glass bottle a weight ratio of 1:1 N,N'-diphenyl-N,N'-bis(3-methylphenyl)-1,1'-biphenyl-4-4'-diamine and MAKROLON 5705, a polycarbonate resin having a molecular weight of from about 50,000 to 100,000 commercially available from Farbenfabriken Bayer A. G. The resulting mixture is dissolved to give a 15 percent by weight solid in 85 percent by weight methylene chloride. This solution is applied onto the photogenerator layer to form a coating which upon drying has a thickness of 24 micrometers.

The structure of the imaging member is examined using TEM photography. The imaging member is also examined for its imaging properties. The imaging member is measured for its discharge from a Vddp of 600 to 100 Volts (E600-100, in Ergs/cm$^2$),of 8.6, a dark decay of −68 and a Vr of 27. The properties of the imaging member are set forth in Table I below.

Examples 2–3

An imaging member is made as in Example 1, except that greater amounts of N,N'-diphenyl-N,N'-bis(3-methylpropyl)-(1,1'-biphenyl)-4,4'-diamine are added, while maintaining the amounts of BzP constant at 40%. The contents of N,N'-diphenyl-N,N'-bis(3-methylpropyl)-(1,1'-biphenyl)-4,4'-diamine are 15 in Example 2 and 30 in Example 3.

The imaging members are analyzed as in Example 1. The properties of the imaging members are set forth in Table I below.

Examples 4–7

Imaging members are made as in Example 1–3, with increasing amounts of N,N'-diphenyl-N,N'-bis(3-methylpropyl)-(1,1'-biphenyl)-4,4'-diamine added, except that the amounts of BzP are correspondingly decreased. The contents of NN'-diphenyl-NN'-bis(3-methylpropyl)-(1,1'-biphenyl)-4,4'-diamine are 6 in Example 4, 11 in Example 5, 15 in Example 6 and 23 in Example 7. The contents of BzP are 38 in Example 4, 36 in Example 5, 34 in Example 6 and 31 in Example 7.

The imaging members are analyzed as in Example 1. The properties of the imaging members are set forth in Table I below.

Comparative Example 1

An imaging member is made as in Examples 1–3, except that no N,N'-diphenyl-N,N'-bis(3-methylpropyl)-(1,1'-biphenyl)4,4'-diamine is added to the CGL. The content of BzP is 40% the content of PC-z is 60%. The imaging members are analyzed as in Examples 1–7. The properties of the imaging members are set forth in Table I below.

TABLE 1

| Example | % BzP | % diamine | O.D. 660 nm | E600-100 | Dark Decay | Vr |
|---|---|---|---|---|---|---|
| Comp Ex | 40 | 0 | 2.3 | 9 | −83 | 30 |
| Ex. 1 | 40 | 10 | 2.3 | 8.6 | −68 | 27 |
| Ex. 2 | 40 | 15 | 2.2 | 8 | −70 | 31 |
| Ex. 3 | 40 | 30 | 2.2 | 7.3 | −68 | 29 |
| Ex. 4 | 38 | 6 | 2.2 | 9 | −78 | 28 |
| Ex. 5 | 36 | 11 | 2.2 | 8.7 | −67 | 29 |
| Ex. 6 | 34 | 15 | 2.2 | 9.4 | −64 | 25 |
| Ex. 7 | 31 | 23 | 2.1 | 9.3 | −63 | 27 |

Figure 2:
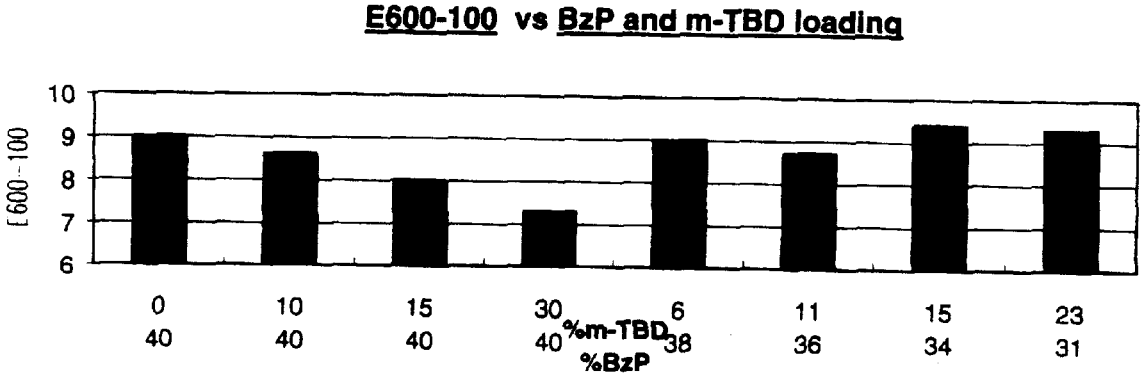
FIG. 2 is a chart that shows photosensitivity data for a series of examples.

FIG. 2 is a chart that gives the photosensitivity data expressed in Ergs/cm$^2$ to discharge from a Vddp of 600 to 100 volts. As N,N'-diphenyl-N,N'-bis(3-methylpropyl)-(1,1'-biphenyl)-4,4'-diamine is added to the charge generating layer and the benzimidazole perylene loading remains constant, the sensitivity increases 20%. As the benzimidazole perylene loading is decreased by the addition of N,N'-diphenyl-N,N'-bis(3-methylpropyl)-1,1'-biphenyl-4,4'diamine, the loss of sensitivity due to decreased loading is counteracted. This may be due to more intimate contact of the benzimidazole perylene particles with each other and with the N,N'-diphenyl-N,N'-bis(3-methylpropyl)-(1,1'-biphenyl)-4,4'-diamine.

While this invention has been described in conjunction with specific embodiments described above, it is evident that many alternatives, modifications and variations will be apparent to those skilled in the art.

Accordingly, the preferred embodiments of the invention, as set forth above, are intended to be illustrative, not limiting. Various changes may be made without departing from the spirit and scope of the invention.

What is claimed is:

1. An electrophotographic imaging member, comprising:

an electrically conductive substrate;

a charge transport layer that comprises a hole transport component;

a charge generating layer that comprises organic photoconductive particles and said hole transport component;

wherein the hole transport component forms a concentration gradient in the charge generating layer such that a lower concentration of the hole transport component is located furthest from the charge transport layer and a higher concentration of the hole transport component is located nearest the charge transport layer;

wherein an amount of the hole transport component in the charge generating layer is effective to block migration of the hole transport component from the charge transport layer to the charge generating layer; and wherein the hole transport component is N,N'-diphenyl-N,N'-bis(3-methylpropyl)-(1,1'-biphenyl)-4,4'-diamine.

2. The electrophotographic imaging member of claim 1 wherein the charge transport layer adjoins the charge generating layer.

3. The electrophotographic imaging member of claim 1 wherein a concentration of N,N'-diphenyl-N,N'-bis(3-methylpropyl)-(1,1'-biphenyl)-4,4'-diamine in the charge transport layer and a concentration of N,N'-diphenyl-N,N'-bis(3-methylpropyl)-(1,1'-biphenyl)-4,4'-diamine in the charge generating layer are substantially the same.

4. The electrophotographic imaging member of claim 1 wherein said organic photoconductive particles are selected from the group consisting of: vanadyl phthalocyanine, copper phthalocyanine, hydroxygallium phthalocyanine, dibromoanthanthrone, squarylium, quinacridones, benzimidazole perylene, substituted 2,4-diamino-triazines, and polynuclear aromatic quinones.

5. The electrophotographic imaging member of claim 1 wherein said organic photoconductive particles are perylene pigments.

6. The electrophotographic imaging member of claim 1 wherein said organic photoconductive particles are benzimidazole perylene.

7. The electrophotographic imaging member of claim 1 wherein said charge generating layer further comprises a polycarbonate.

8. The electrophotographic imaging member of claim 1, wherein the charge transport layer is formed upon the charge generating layer.

9. A method of preparing the electrophotographic imaging member of claim 1, comprising:

forming a charge transport layer that contains a hole transport component comprising charge transport molecules;

forming a charge generating layer that comprises organic photoconductive particles and said hole transport component;

wherein the charge transport layer and the charge generating layer are formed on an electrically conductive substrate;

wherein said charge transport molecules substantially do not migrate from the charge transport layer to the charge generating layer, substantially preventing swelling of the charge generating layer by migration of the transport molecule from the charge transport layer;

wherein the hole transport component forms a concentration gradient in the charge generating layer such that a lower concentration of the hole transport component is located furthest from the charge transport layer and a higher concentration of the hole transport component is located nearest the charge transport layer; and wherein the hole transport component is N,N'-diphenyl-N,N'-bis(3-methylpropyl)-(1,1'-biphenyl)-4,4'-diamine.

10. The method of claim 9 wherein the charge generating layer is formed adjoining to the charge transport layer.

11. The method of preparing an electrophotographic imaging member of claim 9 wherein the concentration of N,N'-diphenyl-N,N'-bis(3-methylpropyl)-(1,1'-biphenyl)-4,4'-diamine in the charge transport layer and in the charge generating layer are substantially the same.

12. The method of preparing an electrophotographic imaging member of claim 9 wherein said organic photoconductive pigments are perylene.

13. The method of preparing an electrophotographic imaging member of claim 12, wherein said perylene photoconductive particles are benzimidazole perylene.

14. The method of preparing an electrophotographic imaging member of claim 9 wherein said charge generating layer has a thickness of about 1 micron prior to forming the charge transport layer and said charge generating layer has a thickness of about 1 micron after forming the charge transport layer.

15. The method of preparing an electrophotographic imaging member of claim 9 wherein the charge generating layer comprises between 5 to 30% by weight of the hole transport component, N,N'-diphenyl-N,N'-bis(3-methylpropyl)-(1,1'-biphenyl)-4,4'-diamine and 30 to 40% by weight of the organic photoconductive particles, and wherein the organic photoconductive particle are benzimidazole perylene.

16. The method of claim 9, wherein the charge transport layer is formed after the charge generating layer is formed.

17. An electrophotographic imaging member formed by the method of claim 9.

* * * * *